US012202026B2

(12) United States Patent
Okada et al.

(10) Patent No.: US 12,202,026 B2
(45) Date of Patent: Jan. 21, 2025

(54) PRESS BRAKE

(71) Applicants: Kawasaki Jukogyo Kabushiki Kaisha, Kobe (JP); LVD Company nv, Gullegem (BE)

(72) Inventors: Hideki Okada, Kobe (JP); Yoshihiro Uetake, Kobe (JP); Takumi Wada, Kobe (JP); Kristof Tyvaert, Gullegem (BE); Alexander Cornelus, Gullegem (BE)

(73) Assignees: KAWASAKI JUKOGYO KABUSHIKI KAISHA, Kobe (JP); LVD COMPANY NV, Gullegem (BE)

( * ) Notice: Subject to any disclaimer, the term of this patent is extended or adjusted under 35 U.S.C. 154(b) by 502 days.

(21) Appl. No.: 17/563,075

(22) Filed: Dec. 28, 2021

(65) Prior Publication Data

US 2022/0118502 A1 Apr. 21, 2022

Related U.S. Application Data

(63) Continuation of application No. PCT/JP2020/025394, filed on Jun. 26, 2020.

(30) Foreign Application Priority Data

Jun. 28, 2019 (JP) ..... 2019-122089

(51) Int. Cl.
*B21D 37/02* (2006.01)
*B21D 5/02* (2006.01)

(52) U.S. Cl.
CPC ..... *B21D 37/02* (2013.01); *B21D 5/02* (2013.01)

(58) Field of Classification Search
CPC ..... B21D 5/002; B21D 5/02; B21D 5/0209; B21D 5/0218; B21D 5/0227;
(Continued)

(56) References Cited

U.S. PATENT DOCUMENTS 6,386,008 B1 * 5/2002 Virtanen ..... B21C 51/00 72/19.8

FOREIGN PATENT DOCUMENTS

DE 2541094 A1 * 9/1975 ..... B21D 7/06
DE 3943349 A1 7/1990
(Continued)

*Primary Examiner* — Debra M Sullivan
*Assistant Examiner* — Matthew Stephens
(74) *Attorney, Agent, or Firm* — XSENSUS LLP

(57) ABSTRACT

There is provided a press brake (1) that, if subjecting a workpiece (90) having non-uniform thickness to bending, can efficiently give uniform curvature to the workpiece (90). The press brake (1) includes: a die (2) supporting the workpiece (90); a punch supporting member (4) arranged so as to be opposed to the die (2); a moving mechanism (5) that moves the punch supporting member (4) relative to the die (2); a punch (3) that is supported by the punch supporting member (4), is opposed to the die (2) or the workpiece (90) in a relative movement direction of the punch supporting member (4), and includes punch elements (3*a*) lined up in a direction orthogonal to the relative movement direction; and punch element adjusting mechanisms that are disposed so as to correspond to the respective punch elements (3*a*) and adjusts positions of the punch elements (3*a*) relative to the punch supporting member (4) in the relative movement direction.

20 Claims, 7 Drawing Sheets

(58) Field of Classification Search
CPC .... B21D 5/0263; B21D 5/0272; B21D 37/02; B21D 37/04; B30B 15/28; B30B 15/281; B30B 15/282; B30B 15/284; B30B 15/285; B30B 15/287; B30B 15/288
See application file for complete search history.

(56) References Cited

FOREIGN PATENT DOCUMENTS

| | | | | | |
|---|---|---|---|---|---|
| DE | 3943349 | C2 | * | 8/2001 | ..... B21D 5/02 |
| GB | 2467785 | A | * | 8/2010 | ..... B21D 5/02 |
| IT | MI20120894 | A1 | * | 11/2013 | ..... B21D 5/002 |
| JP | 50-39470 | Y1 | | 11/1975 | |
| JP | 8-300047 | A | | 11/1996 | |
| JP | 2004330201 | A | * | 11/2004 | ..... B21D 5/02 |
| JP | 2016-59935 | A | | 4/2016 | |
| JP | 2018114527 | A | * | 7/2018 | ..... B21D 5/01 |
| KR | 101424629 | B1 | * | 12/2013 | ..... B21D 7/08 |

* cited by examiner

PRESS BRAKE

CROSS-REFERENCE TO RELATED APPLICATIONS

The present application is a bypass continuation of PCT Filing PCT/JP2020/025394, filed Jun. 26, 2020, which claims priority to JP 2019-122089, filed Jun. 28, 2019, both of which are incorporated by reference in their entirety.

BACKGROUND OF THE INVENTION

1. Field of the Invention

The present disclosure relates to a press brake used for bending.

2. Description of the Related Art

When performing bending with a press brake, a workpiece is placed between upper and lower molds of the press brake. Generally, the lower mold or a mold that does not move is called a "die" and includes a groove that is open at a side that contacts the workpiece. Moreover, the upper mold or a mold that moves is called a "punch" and has a small circular shape at a side that contacts the workpiece. The punch is brought into contact with the workpiece and then presses the workpiece. With this, a groove shape or a bent shape corresponding to a stroke amount of the punch can be given to the workpiece.

Moreover, in order to bend a long workpiece, the press brake has the above-mentioned die and punches extending parallel to each other to form a long dimension. Then, according to such press brake, a vertical distance between the groove of the die and a tip of the punch is constant in a direction in which the groove and the punch extend. In other words, the punch and the die have a constant shape in the cross-sectional direction.

SUMMARY

An object of the present disclosure is to provide a press brake that, if subjecting a workpiece having non-uniform thickness to bending, can efficiently give uniform curvature to the workpiece.

A press brake according to one aspect of the present disclosure is a press brake that performs bending with respect to a workpiece by a die and a punch. The press brake includes: a die; a punch arranged so as to be opposed to the die and including punch elements lined up in a longitudinal direction of the die; a punch supporting member supporting the punch; a moving device that moves the punch supporting member relative to the die in an upper-lower direction; and position controllers that adjust positions of the punch elements relative to the punch supporting member in the upper-lower direction and change a shape of the punch, the shape is collection of by the punch elements.

BRIEF DESCRIPTION OF THE DRAWINGS

FIG. 4A shows that the punch element is located at a lock position, and the operation of an overload preventing mechanism is restricted. FIG. 4B shows that the punch element has moved downward, and the operation of the overload preventing mechanism is allowed.

FIG. 6A shows an overload input initial stage. FIG. 6B shows that a piece member has moved upward by an input overload, and contact members have retreated in a lateral direction. FIG. 6C shows that the upward movement of the piece member has been completed.

DESCRIPTION OF THE PREFERRED EMBODIMENTS

Figure 1:
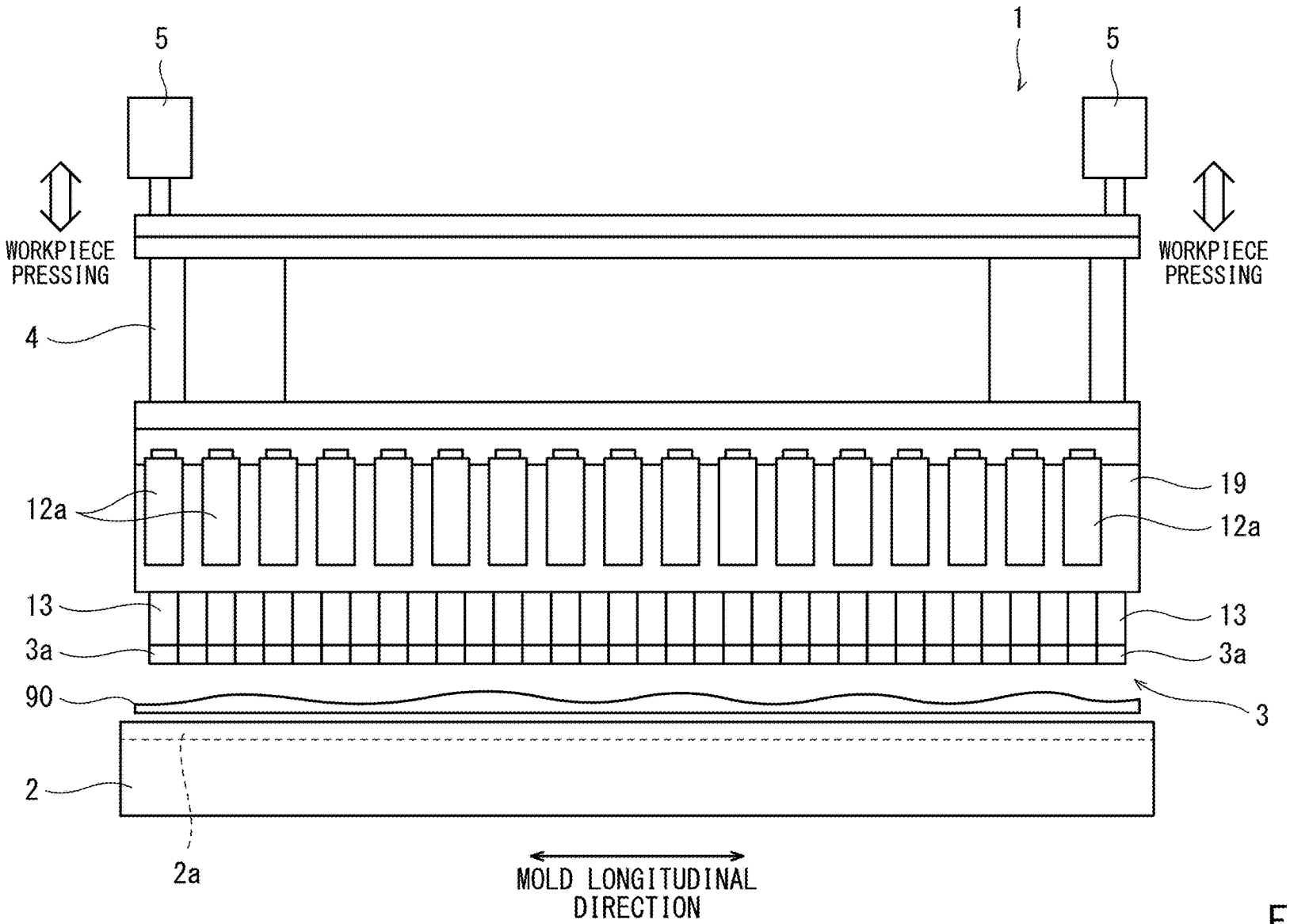
FIG. 1 is a front view of a press brake according to an embodiment and shows that the positions of all punch elements are the same as each other.

Hereinafter, an embodiment will be described with reference to the drawings. In the drawings, the same reference signs are used for the same or corresponding components, and the repetition of the same detailed explanation is avoided.

Figure 2:
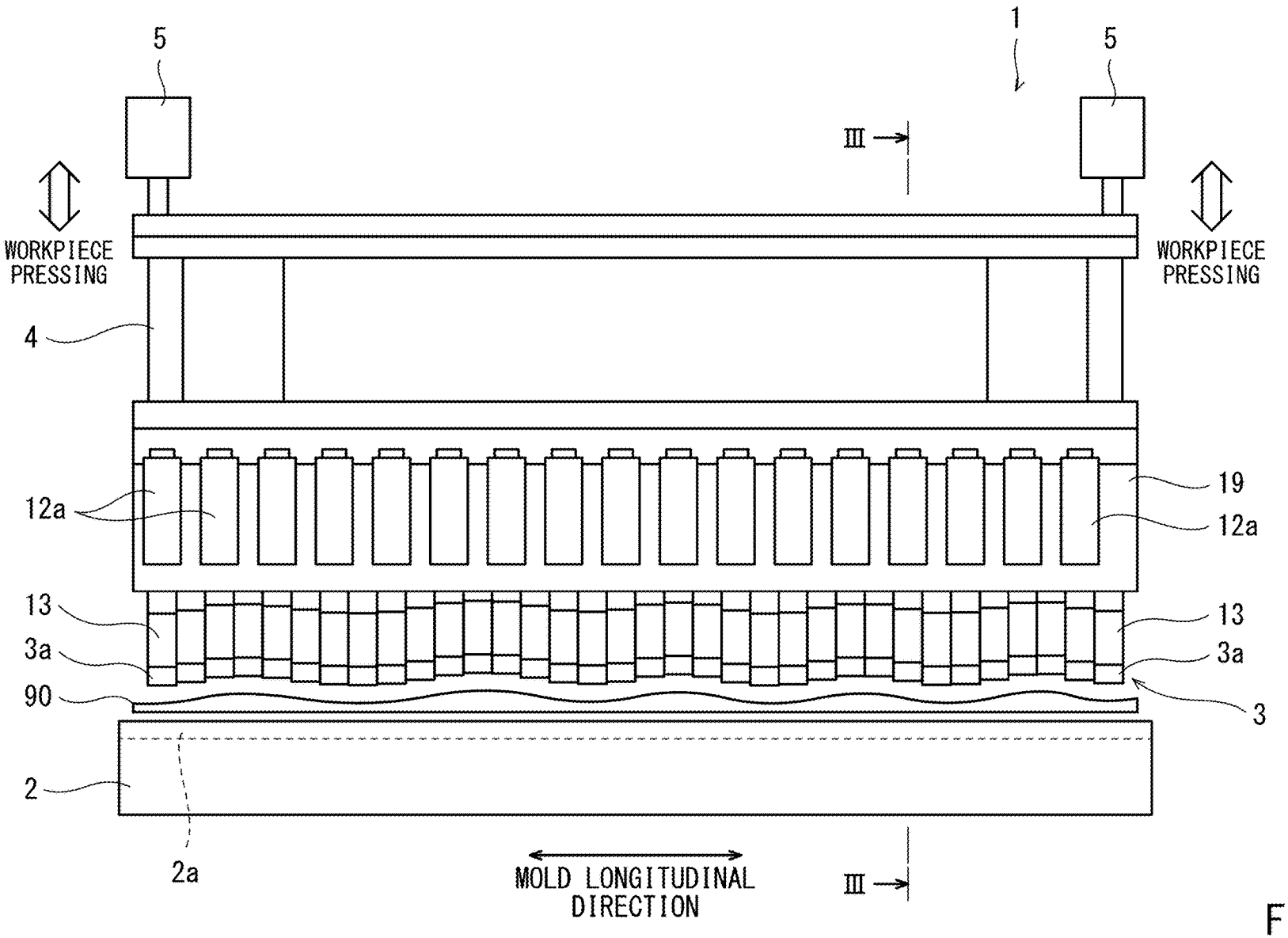
FIG. 2 is a front view of the press brake according to the embodiment and shows that the positions of the punch elements are set in accordance with the thickness of a workpiece.
Figure 3:
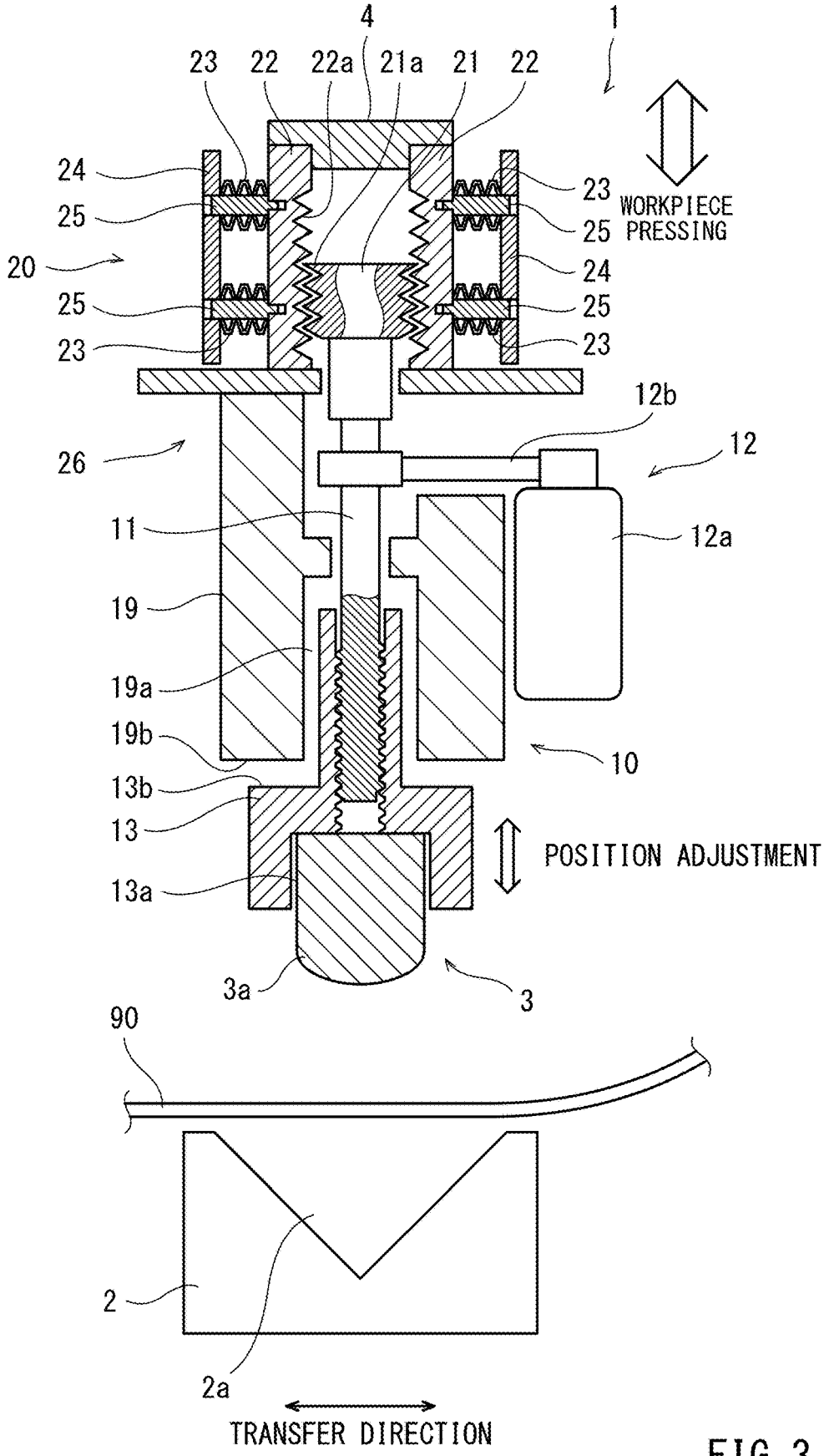
FIG. 3 is a sectional view taken along line of FIG. 2.
Figure 7:
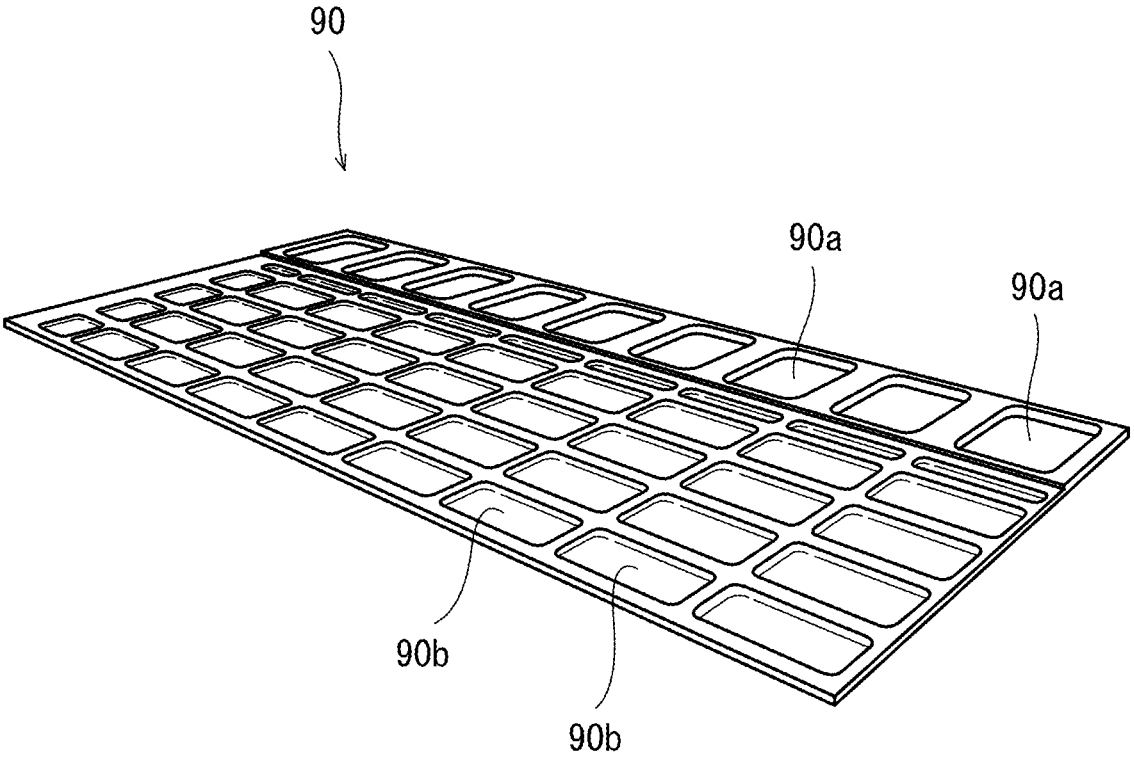
FIG. 7 is a perspective view showing one example of the workpiece that is a target subjected to bending with the press brake.

FIG. 1 and FIG. 2 are front views of a press brake 1 according to the embodiment. FIG. 3 is a sectional view taken along line of FIG. 2. The press brake 1 can subject a workpiece 90 to bending. The material of the workpiece 90 is not especially limited and may be iron metal, such as stainless steel, or aluminum alloy. FIG. 7 shows one example of the workpiece 90. As shown in FIG. 7, one example of the workpiece that can be subjected to appropriate bending with the press brake 1 is the workpiece 90 including, for example, openings 90*a* penetrating in a thickness direction and recesses 90*b* each of which is recessed from one or the other of main surfaces and is therefore partially smaller in thickness than a portion around the recess 90*b*. The workpiece 90 shown in FIG. 7 is comprised such that: the openings 90*a* each having a substantially rectangular shape are formed so as to be lined up in a width direction (below-described "mold longitudinal direction"); and the recesses 90*b* each having a substantially rectangular shape are formed in a matrix manner in the width direction and a direction orthogonal to the width direction.

The press brake 1 can perform multistage bending with respect to the workpiece 90 that is long and wide as above. For example, a circular tube body, such as a skin of an aircraft body portion, having a relatively large diameter can be produced from the workpiece 90. Then, the press brake 1 according to the present embodiment can give a bent shape having uniform curvature in a longitudinal direction to not only the workpiece 90 having uniform thickness but also the workpiece 90 having non-uniform thickness in the longitudinal direction or the width direction without additional work, such as placing of shims. Moreover, the press brake 1 can individually adjust pressing forces applied to respective portions of the workpiece 90. In other words, the shape of a punch can be arbitrarily and timely changed by adjusting the positions of punch elements 3*a* corresponding to the respective portions of the workpiece 90. Therefore, not only a bent shape having uniform curvature but also a three-dimensional bent shape, such as a shape having curvature that changes in the longitudinal direction or the width direction, can be formed. The configuration of the press brake 1 will be described below in detail.

The press brake 1 mainly includes a die 2, a punch 3, a punch supporting member 4, a moving device 5, and punch element adjusting mechanisms 10. In other words, the punch element adjusting mechanisms are position controllers 10. It is publicly known that in the press brake 1, the punch 3 moves relative to the die 2 in an opposing direction that is a direction in which the punch 3 is opposed to the die 2. In the present embodiment, the opposing direction, i.e., a relative movement direction is a typical upper-lower direction, but does not have to be a complete upper-lower direction and may be inclined. The punch 3 and the punch supporting member 4 supporting the punch 3 are arranged above the die 2. An upper surface of the die 2 is a workpiece supporting surface that supports the workpiece 90, and a lower surface of the punch 3 is a workpiece pressing surface that presses the workpiece 90. In the present embodiment, the die 2 is fixedly placed on a floor, and the punch 3 is movable. However, the die 2 may be movable instead of or in addition to the punch 3. Moreover, a positional relation among the punch 3, the punch supporting member 4, and the die 2 is not limited to the above. For example, the punch and the punch supporting member 4 may be set under the die 2.

The moving mechanism 5 moves the punch supporting member 4 and the punch 3, supported by the punch supporting member 4, relative to the die 2. As one example, the moving mechanism 5 includes: a hydraulic cylinder fixedly placed on the floor and including a rod directed in the upper-lower direction; and an electromagnetic valve that controls supply of pressure oil to the hydraulic cylinder and discharge of the pressure oil from the hydraulic cylinder. The moving mechanism 5 does not have to include the hydraulic cylinder and may include, for example, an electric servo. To be specific, the moving mechanism 5 may include a known actuator, such as the above.

To realize bending with respect to the workpiece 90 that is wide, the die 2 is formed long in one horizontal direction. In other words, one horizontal direction is one direction orthogonal to the upper-lower direction that is the relative movement direction. A groove 2*a* that extends in the above horizontal direction and is open upward is formed on the upper surface of the die 2. A sectional shape of the groove 2*a* is not especially limited. One example of the sectional shape of the groove 2*a* is a V shape. The punch 3 is also formed long in the above horizontal direction so as to correspond to the die 2. Hereinafter, the above horizontal direction is referred to as a "mold longitudinal direction." Moreover, a direction perpendicular to the mold longitudinal direction, which is one horizontal direction, and also to the relative movement direction, which is the upper-lower direction, is referred to as a "conveying direction." The conveying direction is the direction orthogonal to the paper surface in FIG. 2 and the left-right direction in FIG. 3. In the present embodiment, the conveying direction is also horizontal. At the time of the bending, the workpiece 90 is conveyed in the conveying direction.

The punch 3 is comprised such that the punch elements 3*a* are arranged in the mold longitudinal direction. In other words, the punch 3 is divided into the punch elements 3*a* in the mold longitudinal direction. As shown in FIG. 1 and FIG. 2, the punch elements 3*a* are arranged in the mold longitudinal direction so as to be laid all over without gaps. Moreover, as shown in FIG. 3, when viewed from the mold longitudinal direction, the punch elements 3*a* are arranged linearly in the mold longitudinal direction without deviating from each other in the conveying direction. The punch elements 3*a* are individually movable relative to the punch supporting member 4 in the upper-lower direction by the actions of the punch element adjusting mechanisms 10. The punch element adjusting mechanisms 10 are disposed so as to correspond to the respective punch elements 3*a* and can individually adjust upper-lower direction positions of the punch elements 3*a*.

As shown in FIG. 3, the punch element adjusting mechanisms 10 are disposed close to the lower surface of the punch supporting member 4. Each of the punch element adjusting mechanisms 10 includes a screw member 11, a drive division 12, a holder 13, and a lock member 19. The lock member 19 is fixed to the lower surface of the punch supporting member 4. The screw member 11 is arranged under the punch supporting member 4 so as to extend in the upper-lower direction and is supported by the lock member 19, in other words, the punch supporting member 4, so as to be rotatable. The drive division 12 rotates the screw member 11. As one example, the drive division 12 includes: an electric motor 12*a*; and a transmission mechanism 12*b* by which rotation output of the electric motor 12*a* is transmitted to the screw member 11. The transmission mechanism 12*b* is, for example, a belt transmission mechanism. The electric motor 12*a* is arranged under the punch supporting member 4 and outside the lock member 19 in the conveying direction. Each of the front views of FIG. 1 and FIG. 2 shows the electric motors 12*a*, the number of which is half the number of punch elements 3*a*. The remaining electric motors 12*a*, the number of which is half the number of punch elements 3*a*, are arranged at a rear surface side. To be specific, the electric motors 12*a* are alternately arranged at the front surface side and the rear surface side in the mold longitudinal direction. By this arrangement, an arrangement space of the electric motors 12*a* is adequately secured while reducing the size of each punch element 3*a*. The sectional view of FIG. 3 shows only the electric motor 12*a* which is arranged at the front surface side so as to correspond to the sectional punch element 3*a*. The same is true in FIG. 4 and FIG. 6.

The lock member 19 includes an accommodating space 19*a* having a non-circular section, as one example, a rectangular section, that is open downward, and the screw member 11 is partially accommodated in the accommodating space 19*a*. As shown in the perspective view portion of FIG. 4B described below, the holder 13 is threadedly engaged with the screw member 11, and a portion thereof having a non-circular section, as one example, a rectangular section, is fitted in the accommodating space 19*a*. By this fitting, the holder 13 is allowed to move in the upper-lower direction, and the rotation of the holder 13 about an axis extending in the upper-lower direction is restricted. The holder 13 includes a holding space 13*a* that is open downward. The punch element 3*a* is accommodated in the holding space 13*a* such that a lower end portion thereof is exposed downward from the holder 13. An upper surface of the punch element 3*a* is brought into contact with an inner upper surface of the holding space 13*a*. With this, an upward load input to the punch element 3*a* is easily transmitted to the holder 13. An outer peripheral portion of the holder 13 includes a shoulder portion having such a step shape that a lower portion thereof is larger in outer diameter than an upper portion thereof. An upper surface 13*b* of the shoulder portion is located so as to be opposed to a lower end surface 19*b* of the lock member 19.

Figure 4B:
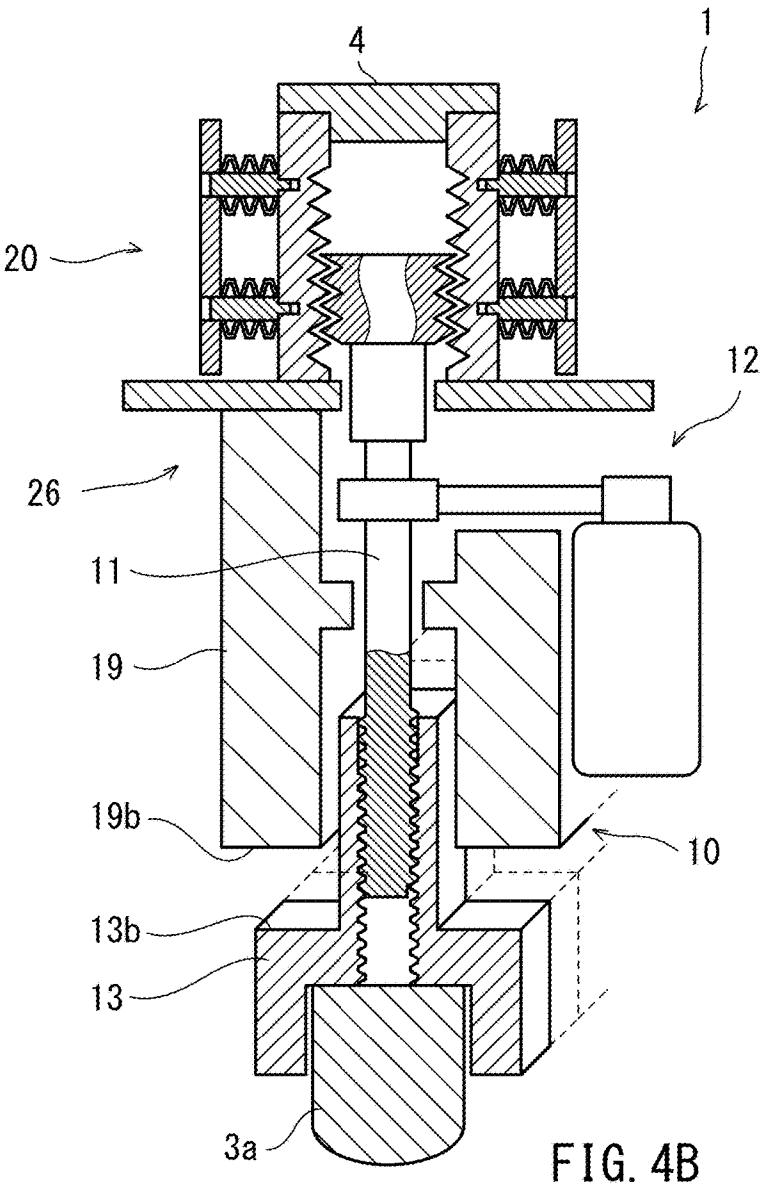
FIG. 4A and FIG. 4B are action diagrams of a punch element adjusting mechanism.
Figure 4A:
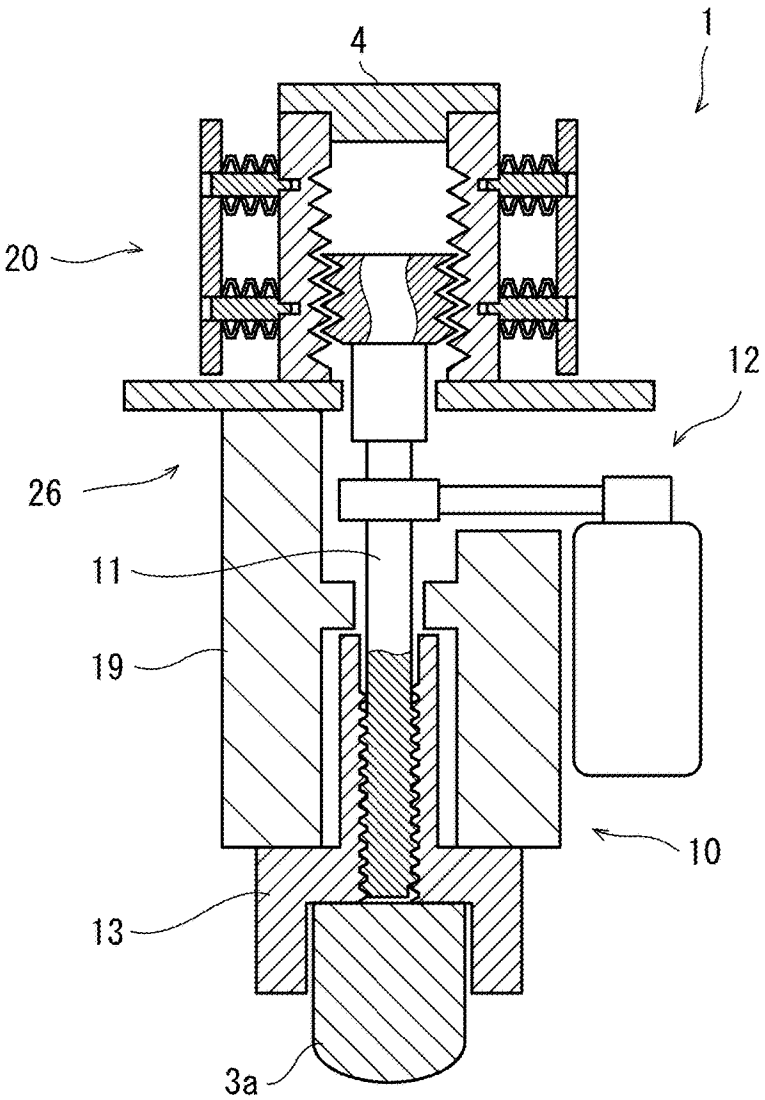

FIG. 4A and FIG. 4B are action diagrams of the punch element adjusting mechanism. In FIG. 4B, the holder 13 and the lock member 19 are partially shown as a perspective view. As described above, the rotation of the holder 13 is restricted by the lock member 19. Therefore, in case the drive division 12 rotates the screw member 11, the holder 13 and the punch element 3*a* held by the holder 13 move in the upper-lower direction. As described above, the lower end surface 19*b* of the lock member 19 is opposed to the upper surface 13*b* of the shoulder portion of the holder 13. Therefore, in case the holder 13 moves upward, the upper surface 13*b* of the shoulder portion is brought into contact with the lower end surface 19*b* of the lock member 19. Positions where the holder 13 and the punch element 3*a* abut on the lock member 19 from below is an upper limit positions of the holder 13 and the punch element 3 *a*. Lower limit positions of the holder 13 and the punch element 3*a* are predetermined positions at which the holder 13 does not fall from the screw member 11. Each of the positions of the holder 13 and the punch element 3*a* is adjusted between the upper limit position and the lower limit position in the upper-lower direction. The above-described configuration of the punch element adjusting mechanism 10 is one suitable example, but the present embodiment is not limited to this configuration.

Figure 5:
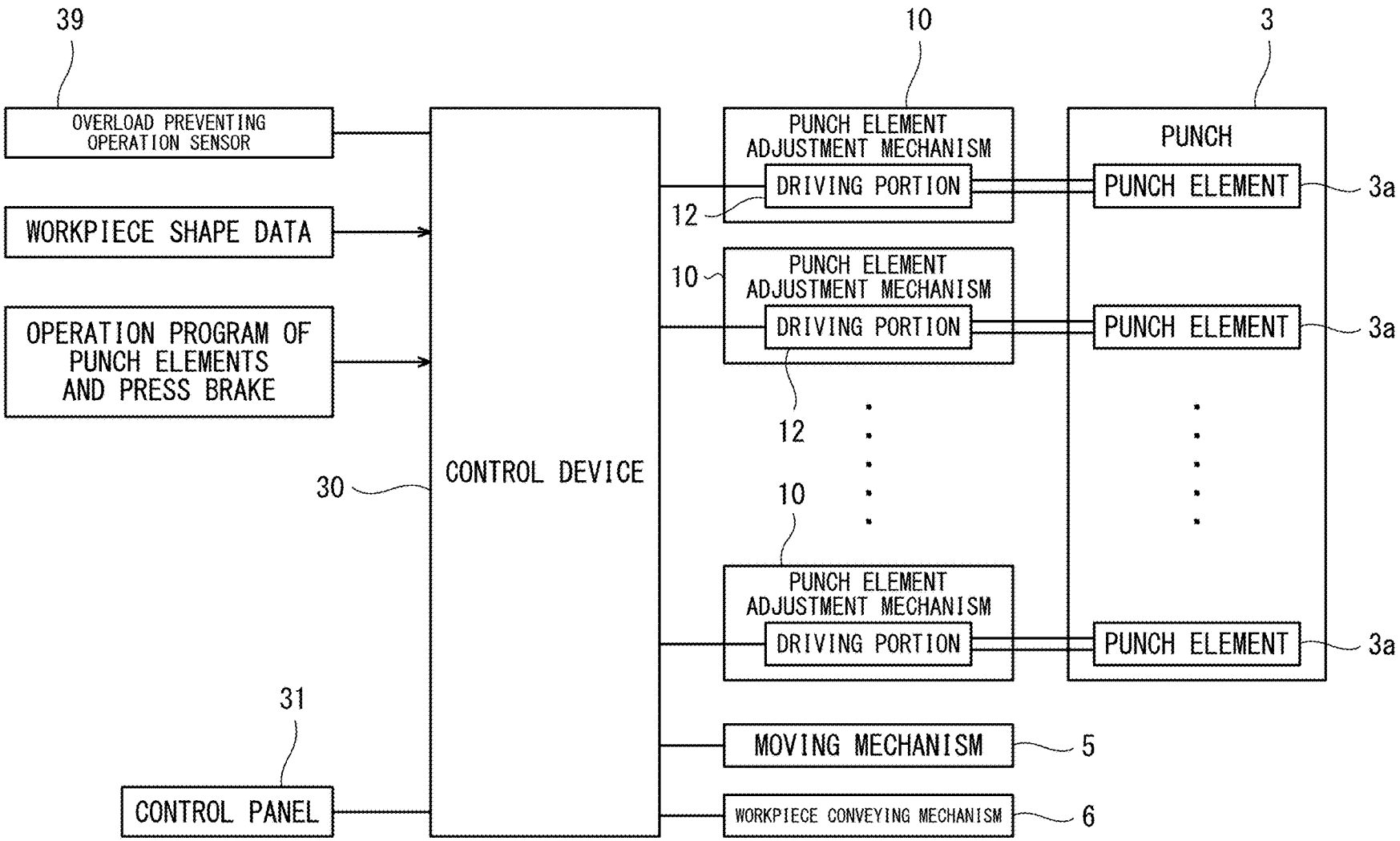
FIG. 5 is a block diagram of the press brake according to the embodiment.

FIG. 5 is a block diagram of the press brake 1 according to the embodiment. As shown in FIG. 5, the press brake 1 includes a control device 30 that controls: a workpiece conveying mechanism 6 that conveys the workpiece 90; the above-described moving mechanism 5 that are shown in FIG. 1 and FIG. 2; and the punch element adjusting mechanisms 10. workpiece conveying mechanism 6 is, in other words, workpiece conveying device 6. The control device 30 is connected to a control panel 31 manipulated by an operator. In case the operator inputs a machining start command to the control panel 31, the control device 30 intermittently drives the workpiece conveying mechanism 6 to convey the workpiece by a predetermined distance and then stops the workpiece conveying mechanism 6 to stop conveying the workpiece 90. Next, the control device 30 drives the moving mechanism 5 to move the punch 3 downward. With this, the workpiece 90 is pressed by the punch 3, and a bent shape is given to the workpiece 90. Then, the control device 30 drives the moving mechanism 5 to move the punch 3 upward and separate the punch 3 from the workpiece 90. By repeating these operations, the workpiece 90 is subjected to multistage bending.

The control device 30 stores data that contains "OPERATION PROGRAM OF PUNCH ELEMENTS AND PRESS BRAKE" shown in FIG. 5, regarding the bending of the workpiece 90 or data that contains "WORKPIECE SHAPE DATA" shown in FIG. 5, regarding the shape of the workpiece 90. Based on this data, the upper-lower direction position of the punch element 3*a* is adjusted in accordance with the thickness of a portion of the workpiece 90, the portion being supported on the die 2 regarding the longitudinal direction. At the start of the bending, the above adjustment is performed before the punch 3 first presses the workpiece 90. After that, the adjustment is performed in a period from when the punch 3 moves upward until when the punch 3 moves downward again.

As also shown in FIG. 2, the thickness of the workpiece 90 may not be uniform in at least the width direction. In the present embodiment, the width direction of the workpiece 90 coincides with the mold longitudinal direction. The upper-lower direction positions of the punch elements 3*a* arranged in the mold longitudinal direction are adjusted in accordance with the thicknesses of portions that the punch elements 3*a* themselves press. At a portion having relatively thinner thickness, the position of the punch element 3*a* is adjusted to a relatively upper position. The position of the punch element 3*a* that presses a portion having relatively thinner thickness is adjusted to a relatively lower position. In other words, the position of the punch element 3*a* at the portion having the relatively thicker thickness is adjusted to a position located farther from the workpiece 90 than the position of the punch element 3*a* at the portion having the relatively thinner thickness. In the present embodiment, the position is an upper position.

If the punch supporting member 4 moves downward after the above adjustment, the workpiece 90 receives most suitable punch strokes corresponding to the respective thicknesses right under the punch elements 3*a* without shims that fill thickness differences. Therefore, the workpiece 90 can be bent so as to have uniform curvature entirely in the width direction, and additional work of placing the shims is unnecessary. Thus, work efficiency of the bending improves, and quality improves.

When performing the above bending, there may be a deviation between ideal shape data and an actual workpiece shape dimension at least within a tolerance range. Moreover, in the workpiece 90, in case there is an extremely thicker thickness difference between a portion corresponding to one of the punch elements 3*a* and a portion corresponding to its adjacent punch element 3*a*, a high load acts on one of these two punch elements 3*a*. By a series of such situations, excessively high reaction force may be input to a certain punch element 3*a* from the workpiece 90.

Therefore, the press brake 1 includes an overload preventing mechanism 20 that, even if excessively high reaction force is input to the punch element 3*a*, releases such overload from the punch element adjusting mechanism 10 and makes another portion receive the overload. The overload preventing mechanism 20 is, in other words, overload preventing device 20. With this, the punch element adjusting mechanism 10 is protected. In addition, the press brake 1 includes a punch position locking mechanism 26 that releases the overload from not only the punch element adjusting mechanism 10 but also the overload preventing mechanism 20 under a predetermined condition. The punch position locking mechanism 26 is, in other words, punch position locking device 26. Even if excessively high reaction force is input to the punch element 3*a*, the overload is received by the punch supporting member 4 by the action of the punch position locking mechanism 26. Hereinafter, the configuration for countermeasures against the overload will be described.

As shown in FIG. 3, the overload preventing mechanism 20 has a piece member 21, which is connected to the punch element adjusting mechanism 10 with the punch element 3*a*, receiving reaction force from workpiece, a contact member 22, which contacts the piece member 21 from a lateral side, and biasing members 23, which is supported by the punch supporting member 4 to push the contact member 22 to contact to the piece member 21.

As one example, the piece member 21 is formed in a cube shape. A lower surface of the piece member 21 is coupled to an upper surface of the punch element adjusting mechanism 10, especially an upper surface of the screw member 11. The piece member 21 does not work in association with the rotation of the screw member 11 but is mechanically coupled to the screw member 11 such that a load acting on the screw member 11 from below is transmitted upward. In the present embodiment, two assemblies each comprised by the contact member 22 and the biasing members 23 are disposed. Among two pairs of opposing surfaces of the piece member 21 having the cube shape, the two contact members 22 respectively contact a pair of opposing surfaces that are a conveying direction upstream surface and a conveying direction downstream surface. The piece member 21 is sandwiched by contact surfaces of the two contact members 22 from upstream and downstream sides in the conveying direction. To be specific, among four side surfaces of the piece member 21, two surfaces facing the upstream and downstream sides in the conveying direction are contact surfaces that contact the respective contact members 22.

If focusing on one contact member 22 and the piece member 21 including one contact surface that contacts the contact member 22, recessed-projecting strips 21*a* are lined up in the upper-lower direction on the contact surface of the piece member 21, and recessed-projecting strips 22*a* are lined up in the upper-lower direction on the contact surface of the contact member 22. The recessed-projecting strips 21*a* of the piece member 21 and the recessed-projecting strips 22*a* of the contact member 22 are engaged with each other and extend in a direction, in other words, in a direction intersecting with the conveying direction that is a normal direction of the contact surface, intersecting with the upper-lower direction. The upper-lower direction, in other words, relative movement direction. In the present embodiment, the "direction intersecting with the upper-lower direction and the conveying direction" is a direction orthogonal to both the upper-lower direction and the conveying direction, i.e., the "direction intersecting with the upper-lower direction (and the conveying direction)" is the mold longitudinal direction. As one example, the recessed-projecting strips 21*a* and 22*a* are formed such that V-shaped mountain shapes and V-shaped valley shapes are lined up in the upper-lower direction. The contact surface of the piece member 21 and the contact surface of the contact member 22 are engaged with each other such that the mountain shape of one of the piece member 21 and the contact member 22 is fitted in the valley shape of the other of the piece member 21 and the contact member 22. In the drawings, for convenience sake, a gap is formed between the piece member 21 and the contact member 22. However, actually, the contact member 22 tightly contacts the piece member 21.

The contact member 22 is movable in the conveying direction, but the movement of the contact member 22 in the upper-lower direction is restricted. The biasing member 23 applies biasing force to a surface of the contact member 22 in such a direction that the contact member 22 approaches the piece member 21, the surface being opposite to the contact surface the contact member 22. The biasing member 23 is supported by a retainer 24 that is not movable relative to the punch supporting member 4 in the conveying direction. The retainer 24 is arranged at an opposite side of the piece member 21 across the contact member 22 in the conveying direction. The biasing member 23 is disposed in a space between the retainer 24 and the contact member 22. The biasing member 23 may be realized by any part or any structure as long as the biasing member 23 can generate the biasing force that pushes the contact member 22 back in case the contact member is about to move toward the retainer 24. In the present embodiment, the biasing member 23 is realized by stacking disc springs. A method of arranging the disc springs (for example, whether the disc springs are arranged in series or in parallel) is not especially limited. A shaft-shaped holding tool 25 extending in the conveying direction is disposed between the retainer 24 and the contact member 22. By inserting the holding tool 25 into the disc springs, the disc springs are held by the holding tool 25 so as to be stacked in the conveying direction.

The punch position locking mechanism 26 transmits the load, input to the punch element 3*a*, to the punch supporting member 4 without through the overload preventing mechanism 20. The punch position locking mechanism 26 includes the holder 13 and the lock member 19. The lock member 19 works as a member constituting the punch element adjusting mechanism 10 and also works as a member constituting the punch position locking mechanism 26.

Figures 6A, 6B, 6C:
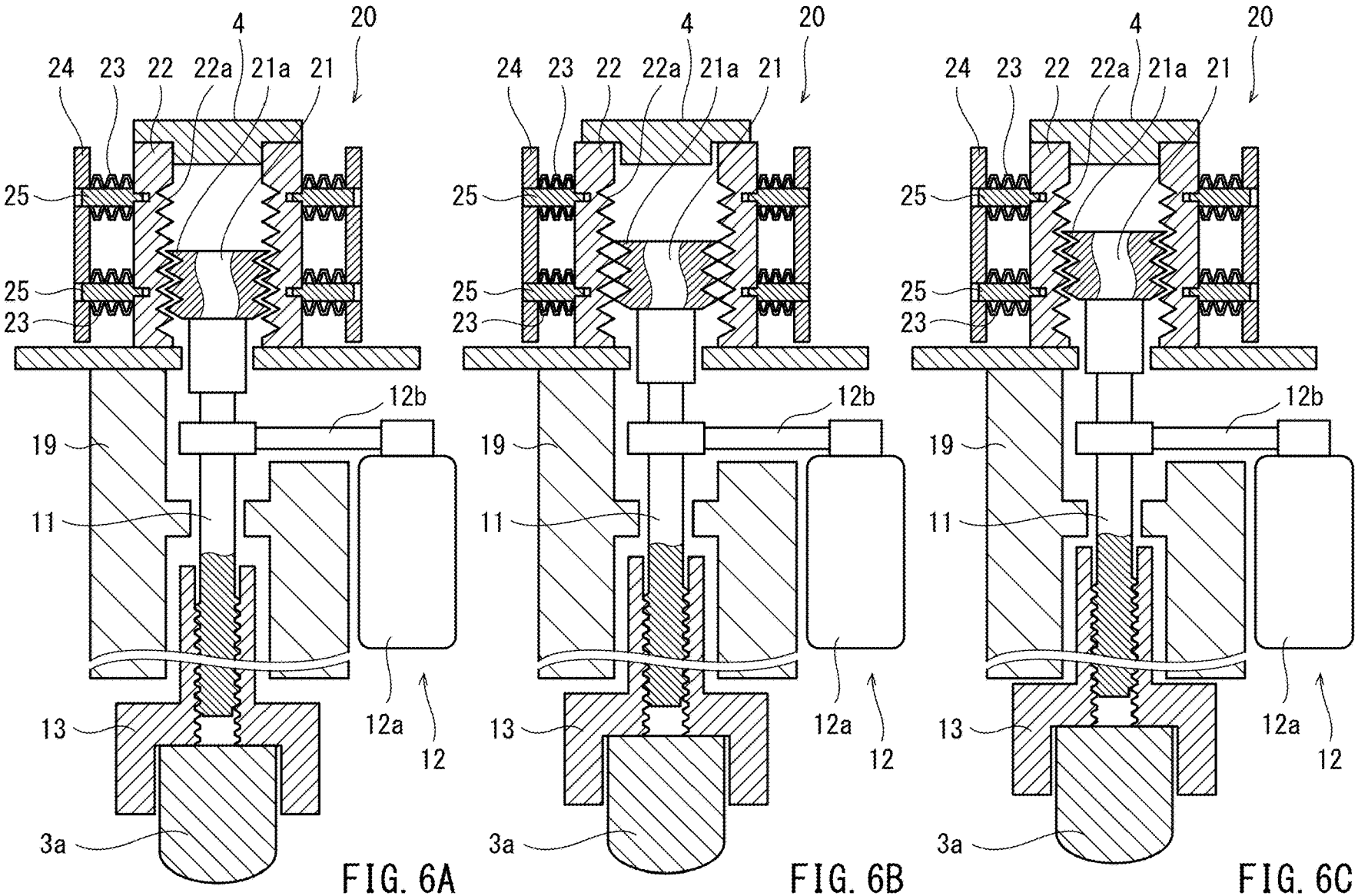
FIG. 6A to FIG. 6C are action diagrams of the overload preventing mechanism.

The following will be described with reference to FIG. 6A to FIG. 6C. A working condition of the overload preventing mechanism 20 is a condition that the punch element 3*a* is not located at the upper limit position. In other words, the working condition of the overload preventing mechanism 20 is a condition that the upper surface 13*b* of the shoulder portion of the holder 13 is not in contact with the lower end surface 19*b* of the lock member 19. Under such circumstances, if upward reaction force is applied from the workpiece 90 to the punch element 3*a*, upward load is transmitted through the punch element 3*a*, the holder 13, and the screw member 11 to the piece member 21. Since the upper surface of the punch element 3*a* is in contact with the inner upper surface of the holder 13, the load is smoothly transmitted from the punch element 3*a* to the holder 13 in the upper direction. Then, the load is transmitted from the holder 13 to the screw member 11 in the upper direction through a screw threadedly-engaged portion between the holder 13 and the screw member 11. The piece member 21 is about to move upward together with the screw member 11, the holder 13, and the punch element 3*a*. The piece member 21 is engaged with the contact members 22 in the conveying direction through the recessed-projecting strips 21*a* and 22*a* lined up in the upper-lower direction. Therefore, when the piece member 21 is about to move upward, the load in the conveying direction is transmitted to the contact members 22 by the wedging action. As above, the recessed-projecting strips 21*a* and 22*a* serve as a load transmitting structure that converts a vertical load into a horizontal load and transmits the horizontal load to the biasing members 23. In case the load is an excessively large load larger than the biasing force of the biasing members 23, the contact member 22 moves in the conveying direction so as to approach the retainer 24 against the biasing force, since the movement of the contact member 22 in the upper-lower direction is restricted. On the other hand, the piece member 21 moves upward. When the piece member 21 moves upward and gets over one recessed-projecting strip, the contact member 22 and the piece member 21 are disengaged from each other in a moment. Then, by the actions of the biasing members 23, the contact members 22 are biased in the conveying direction so as to tightly contact the piece member 21. With this, the piece member 21, the screw member 11, the holder 13, and the punch element 3*a* move upward by a distance corresponding to one recessed-projecting strip. Until the input of the overload terminates, the piece member 21 moves upward and gets over one or more recessed-projecting strips together with the punch element 3*a*.

As above, the overload input to the punch element 3*a*, the holder 13, and the screw member 11 is received or absorbed by the overload preventing mechanism 20, especially, the biasing members 23. Therefore, the punch element adjusting mechanism 10, in the present embodiment, the drive division 12 and the screw threadedly-engaged portion between the holder 13 and the screw member 11, can be protected. In the punch element adjusting mechanism 10, the screw member 11 and the holder 13 move upward together with the punch element 3*a* and the piece member 21, but the positions of the drive division 12 and the lock member 19 relative to the punch supporting member 4 do not change. A driven pulley of the transmission mechanism 12*b* is disposed on the screw member 11 so as to rotate integrally with the screw member 11 and allow the movement of the screw member 11 in the axial direction. As one example, the driven pulley may be splined to the screw member 11. With this, the electric motor 12*a* can be supported by the punch supporting member 4 or the lock member 19 fixed to the punch supporting member 4.

If the overload preventing mechanism 20 operates, the upper-lower direction position of the punch element 3*a* is moved upward from an initial position by the distance of the upward movement of the piece member 21. The press brake 1 may include an overload preventing operation sensor 39 that detects the operation of the overload preventing mechanism 20 (see FIG. 5). The overload preventing operation sensor 39 may detect whether or not the overload preventing mechanism 20 has operated. In this case, when the operation is detected by the overload preventing operation sensor 39, the pressing may be once stopped, and a predetermined warning device may inform the operator that excessively large reaction force has been input to the punch element 3*a*. Or, the overload preventing operation sensor 39 may detect the distance of the upward movement of the piece member 21 moved by the overload preventing mechanism 20. In case the upward movement of the piece member 21 is detected by the overload preventing operation sensor 39, but it is confirmed that the forming can be performed in this state without any problem, the stroke amount set in accordance with the thickness may be corrected by the distance of the upward movement, and subsequent pressing may be executed.

The following will be described with reference to FIG. 4A. A working condition of the punch position locking mechanism 26 is a condition opposite to the working condition of the overload preventing mechanism 20. To be specific, the working condition of the punch position locking mechanism 26 is a condition that: the punch element 3*a* is located at the upper limit position, in other words, an initial position of the punch element 3*a*; and the upper surface 13*b* of the shoulder portion of the holder 13 is in contact with the lower end surface 19*b* of the lock member 19. Under these circumstances, the lock member 19 is sandwiched and interposed between the punch supporting member 4 and the holder 13, and the punch element 3*a* held by the holder 13, in the upper-lower direction. In case upward reaction force is applied from the workpiece 90 to the punch element 3*a*, an upward load is transmitted through the punch element 3*a* and the holder 13 to the lock member 19, not to the screw member 11. Since the lock member 19 is fixed to the lower surface of the punch supporting member 4, the load is smoothly transmitted from the lock member 19 to the punch supporting member 4 in the upper direction. Unlike during the operation of the overload preventing mechanism 20, the overload input to the punch element 3*a* is released from the punch element adjusting mechanism 10 and the overload preventing mechanism 20 and is received by the punch supporting member 4. With this, if the punch element 3*a* is located at the upper limit position, the overload preventing mechanism 20 can be protected. Or, in case the forming needs to be performed by applying to the workpiece 90 a load that exceeds an upper limit load receivable by the overload preventing mechanism 20, this function can be activated.

The functionality of the elements disclosed herein may be implemented using circuitry or processing circuitry which includes general purpose processors, special purpose processors, integrated circuits, ASICs ("Application Specific Integrated Circuits"), conventional circuitry and/or combinations thereof which are configured or programmed to perform the disclosed functionality. Processors are considered processing circuitry or circuitry as they include transistors and other circuitry therein. The processor may be a programmed processor which executes a program stored in a memory. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The foregoing has described the embodiment, but the above configuration is merely one example. Modifications, additions, and/or eliminations may be suitably made.

What is claimed is:

1. A press brake comprising:

a die;

a punch opposing the die and including punch elements lined up in a longitudinal direction of the die, each punch element having a position controller and overload preventer associated with the position controller;

a punch support supporting the punch; and a moving actuator configured to move the punch support relative to the die in an upper-lower direction;

wherein the position controllers are configured to adjust positions of the punch elements relative to the punch support in the upper-lower direction to change a shape of the punch, the shape is collection of the punch elements, each position controller including a screw and a holder threadingly engaged with the screw, each overload preventer has a portion attached to and extending from an axial end of a respective one of the position controllers to allow movement of a respective one of the punch elements in the upper-lower direction in response to a load input to the respective punch element exceeding a set value, and the position controllers are configured to individually adjust pressing forces applied to respective portions of a workpiece.

2. The press brake according to claim 1, wherein each of the overload preventers includes:

a piece coupled to the punch element, the load being transmitted to the piece;

a contact that is in contact with the piece from a lateral side;

a biaser that is supported by the punch support, biases the contact in such a direction that the contact approaches the piece, and restricts movement of the piece in the upper-lower direction; and a load transmitting structure that transmits the load from the piece to the biaser and cancels the restriction of the movement of the piece in the upper-lower direction.

3. The press brake according to claim 2, wherein:

the load transmitting structure includes recessed-projecting strips lined up in the upper-lower direction on a contact surface of the piece and recessed-projecting strips lined up in the upper-lower direction on a contact surface of the contact, the recessed-projecting strips of the piece and the recessed-projecting strips of the contact being engaged with each other and extending in a direction intersecting with the upper-lower; direction, and in case the load exceeds the set value, the piece and the contact are disengaged from each other.

4. The press brake according to claim 1, wherein:

each of the overload preventing preventers includes a piece coupled to the punch element, the load being transmitted to the piece;

a contact that is in contact with the piece from a lateral side; and a biasing that is supported by the punch support and biases the contact in such a direction that the contact approaches the piece; and recessed-projecting strips are lined up in the upper-lower direction on a contact surface of the piece, and recessed-projecting strips are lined up in the upper-lower direction on a contact surface of the contact, the recessed-projecting strips of the piece and the recessed-projecting strips of the contact are engaged with each other and extend in a direction intersecting with the upper-lower direction, and in case the load exceeds the set value, the piece and the contact are disengaged from each other.

5. The press brake according to claim 1, further comprising punch position locks that are configured to transmit the load, input to the punch elements, to the punch supports without being transmitted through the overload preventers in case the punch elements are located at a predetermined position.

6. The press brake according to claim 5, wherein in response to a respective one of the punch elements being located at an initial position in which a shape of the punch has not been changed by the position controllers, a respective one of the punch position locks transmits the load, input to the respective punch element, to the punch support without being transmitted through a respective one of the overload preventers.

7. The press brake according to claim 5, wherein:

the position controllers are disposed for the respective punch elements; and each of the position controllers includes the screw supported so as to be rotatable about an axis of the screw, a drive division that rotates the screw, and the holder that, moves in the upper-lower direction in accordance with rotation of the screw, and holds the punch element.

8. The press brake according to claim 7, wherein:

each punch position lock includes a lock that is sandwiched and interposed between the punch support and a respective one of the holders in the upper-lower direction; and in response to the respective holder being in contact with a lower end of the respective lock, the load input to a respective one of the punch elements the is transmitted to the punch support without being transmitted through a respective one of the overload preventers.

9. The press brake according to claim 5, wherein in response to a respective one of the punch elements being located at an initial position in which a shape of the punch has not been changed by the means for adjusting positions, a respective one of the punch position locks transmits the load, input to the respective punch element, to the punch without being transmitted through a respective one of the means for preventing overload.

10. The press brake according to claim 1, wherein a shape of the punch can be changed by adjusting the positions of punch elements to form a three-dimensional bent shape.

11. The press brake according to claim 1, wherein each position controller includes a drive division, each drive division including:

an electric motor; and a transmission, and each drive division is configured to rotate a respective one of the screws to adjust a height position of a respective one of the punch elements.

12. The press brake according to claim 11, wherein each of the overload preventers includes:

a plurality of springs;

a retainer that has a fixed position and retains the plurality of springs, and in response to the load input to a respective one of the punch elements exceeding the set value, the plurality of springs of a respective one of the overload preventers deflects to allow movement of the respective punch element in the upper-lower direction.

13. The press brake according to claim 12, wherein each of the overload preventers further includes:

a piece having recessed-projection strips, the plurality of springs engaging the piece; and a contact extending from a respective one of the screws, the contact having projection strips.

14. The press brake according to claim 13, wherein for each of the overload preventers, in response to the load input being below the set value, the projection strips of the contact engage the recessed-projection strips of the piece, and in response to response to the load input being above the set value, the projection strips of the contact move with respect to the recessed-projection strips of the piece.

15. The press brake according to claim 1, wherein each of the overload preventers includes:

a plurality of springs;

a retainer that has a fixed position and retains the plurality of springs, and in response to the load input to a respective one of the punch elements exceeding the set value, the plurality of springs of a respective one of the overload preventers deflects to allow movement of the respective punch element in the upper-lower direction.

16. The press brake according to claim 15, wherein each of the overload preventers further includes:

a piece having recessed-projection strips, the plurality of springs engaging the piece; and a contact extending from a respective one of the screws and having projection strips.

17. The press brake according to claim 16, wherein for each of the overload preventers, in response to the load input being below the set value, the projection strips of the contact engage the recessed-projection strips of the piece, and in response to response to the load input being above the set value, the projection strips of the contact move with respect to the recessed-projection strips of the piece.

18. A press brake comprising:

a die;

a punch opposing the die and including punch elements lined up in a longitudinal direction of the die, each punch element having a means for adjusting position and a means for preventing overload with the means for adjusting position;

a punch support supporting the punch; and a means for moving the punch support relative to the die in an upper-lower direction, wherein each of the means for adjusting position adjusts the position of the respective punch elements relative to the punch support in the upper-lower direction to change a shape of the punch, the shape is collection of the plurality of punch elements, and each of the means for adjusting position includes a screw and a holder threadingly engaged with the screw, each of the means for preventing overload includes a portion attached to and extending from an axial end of a respective one of the means for adjusting positions of the punch elements to allow movement of a respective one of the punch elements in the upper-lower direction in response to a load input to the respective punch element exceeding a set value, and the means for adjusting position individually adjust pressing forces applied to respective portions of a workpiece.

19. The press brake according to claim 18, wherein each of the means for preventing overload includes:

a piece coupled to the punch element and configured such that the load is transmitted to the piece;

a contact that is in contact with the piece from a lateral side;

a biaser that is supported by the punch support and configured to bias the contact in such a direction that the contact approaches the piece, and restricts movement of the piece in the upper-lower direction; and a load transmitting structure configured to transmit the load from the piece to the biaser and cancel the restriction of the movement of the piece in the upper-lower direction.

20. The press brake according to claim 19, further comprising punch position locks that transmit the load, input to the punch elements, to the punch supports without being transmitted through the means for preventing overload in case the punch elements are located at a predetermined position.

* * * * *